US005269599A

United States Patent [19]

Moring

[11] Patent Number: 5,269,599

[45] Date of Patent: Dec. 14, 1993

[54] CAMPER'S CHUCK CABINET

[76] Inventor: Stephen E. Moring, 400 Fathom Dr., San Mateo, Calif. 94404-1004

[21] Appl. No.: 907,130

[22] Filed: Jul. 1, 1992

[51] Int. Cl.[5] ..... A47B 81/00

[52] U.S. Cl. ..... 312/290; 312/321.5; 312/902

[58] Field of Search ..... 312/290, 311, 321.5, 312/244, 902

[56] References Cited

U.S. PATENT DOCUMENTS

| | | | |
|---|---|---|---|
| 258,665 | 5/1882 | Murdock | 312/290 |
| 1,590,586 | 6/1926 | McDonald | 190/12 |
| 1,659,114 | 2/1928 | McDonald | 190/12 |
| 1,984,345 | 12/1934 | Kennedy | 312/290 |
| 2,203,563 | 6/1940 | Ekstrom | 312/902 |
| 2,521,572 | 9/1950 | Eckel | 312/290 |
| 2,639,793 | 5/1953 | Hellman | 312/290 |
| 2,739,863 | 3/1956 | Ferris | 312/290 |
| 2,939,756 | 6/1960 | Butcher | 312/290 |
| 3,543,890 | 12/1970 | Criswell | 190/12 |
| 3,558,205 | 1/1971 | Mueller | 312/902 |
| 4,195,889 | 4/1980 | Coyne | 312/902 |
| 5,102,209 | 4/1992 | Hesseltine | 312/290 |

FOREIGN PATENT DOCUMENTS

| | | | |
|---|---|---|---|
| 655348 | 1/1935 | Fed. Rep. of Germany | 312/290 |
| 351843 | 7/1931 | United Kingdom | 312/290 |

*Primary Examiner*—Peter M. Cuomo
*Assistant Examiner*—Flemming Saether

[57] ABSTRACT

A cabinet designed for the storage of basic kitchen utensils, cookware and food stuffs which is designed for use by campers and work crews in remote locations. It consists of a trunk-like cabinet with multiple compartments, a convertible top and front panels which open into a portable kitchen. Unique features include a drawer and slideable trays for maximum accessibility of contents, a paper towel rack, fluorescent lamp and convertible utility compartment.

6 Claims, 2 Drawing Sheets

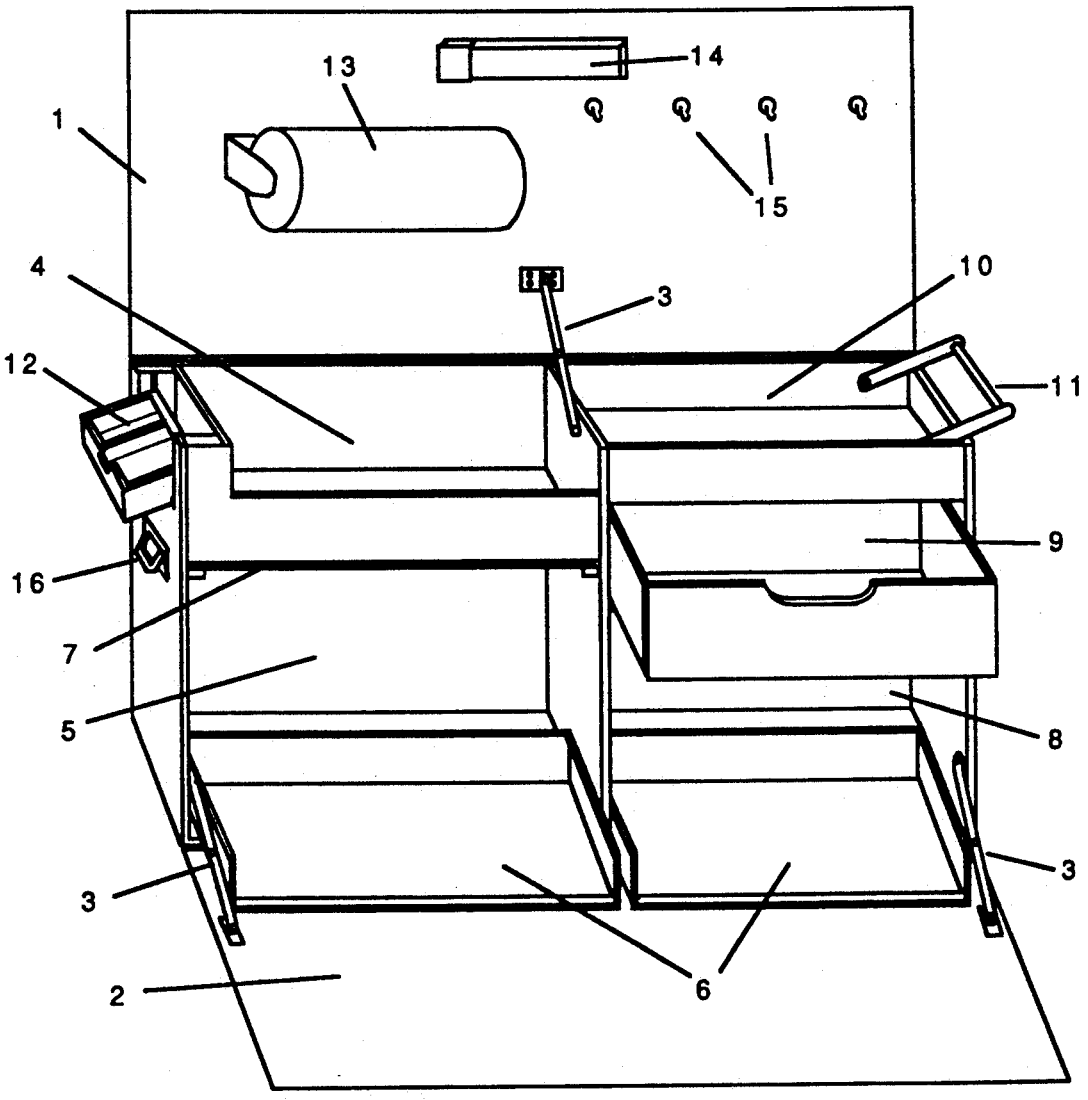
1
2
3
3
4
5
6
6
7
8
9
10
11
12
13
14
15
16

CAMPER'S CHUCK CABINET

FIELD OF INVENTION

This invention relates to a cabinet used for the carrying and storage of camping cookware and food. The unique features are described herein and claimed.

BACKGROUND AND PRIOR ART

The use of cabinets and storage boxes of many of designs is commonplace today for a variety of purposes. However, the modern use of storage containers for camping supplies is limited to knapsacks, picnic baskets, and coolers of various designs. In my experience as a regular camper, I have frequently been amazed by the lack of well designed, ergonomic, containers for storing, transporting and accessing basic food stuffs, consumables and camp cookware.

With the increasing use of automobiles in the 1920s and 30s numerous inventions were described and awarded patents based upon the concept of a trunk-like container designed for the purpose of storing camping and kitchen related supplies. U.S. Pat. Nos. 1,590,586 and 1,659,114 to McDonald (1926 and 1928 resp.), disclose camp kits which contain various compartments for the storage of food condiments, cookware, and eating utensils. Both inventions include an ice box and convertible tables. They are also designed to be carried on, secured to and used from the running board of early automobiles. Other features disclosed include camp stoves, compartments for carrying a suit case and picnic benches.

These camp kit designs attempted to include as many camping accessories as possible and were limited in their capacity to store basic food stuffs, cookware, utensils and kitchen related consumables.

A more recent invention, U.S. Pat. No. 3,543,890 to Criswell (1968) discloses a trunk-like box described as a camper kitchen. It incorporates a convertible front which folds down and locks into place by means of support hinges to provide a horizontal work surface. This invention also incorporates retractable legs into the body of the trunk. A disadvantage to its design is the lack of a top which opens to provide maximum accessibility to its contents.

OBJECTS AND ADVANTAGES

My invention is a cabinet for the storage of basic food stuff, cookware, utensils and consumables. It is also designed to be easily carried to and from a modern automobile, boat or airplane to a camp or other remote settings. The invention is to be used from the top of a picnic table or the bed of a truck or van type automobile.

The cabinet design is simple and ergonomic maximizing accessibility of the stored contents as well as providing a well laid out work surface for preparing meals.

The cabinet design includes features which incorporate and utilize modern kitchen devices such as a paper towel dispenser, towel rack, toiletry kit and an energy saving fluorescent lamp.

The cabinet provides multiple, convertible, food preparation surfaces which can be cleaned and maintained by the owner in contrast to highly variable conditions of picnic tables provided in camp grounds. The cabinet can be locked and easily moved to a secure place out of reach of vermin.

This cabinet is designed for the use of storing nonperishable food, camp cookware, utensils and consumables exclusive of a cooler and stove. Well designed and commercialized coolers and camp stoves are available today, and complement this cabinet concept (These items pack together well in a vehicle and are comparable in size to the storage cabinet of this invention).

Finally, the most important feature of my invention is its use as a self-contained camp storage unit which when properly stocked provides the user with needed supplies at a moments need for recreation or emergency.

DESCRIPTION OF DRAWINGS

FIG. 1. Front view of cabinet with hinged top and front panel in an open and in secured position. The view shows a drawer, trays, towel rack and utility box in extended position.

DESCRIPTION OF INVENTION

Figure 2A:
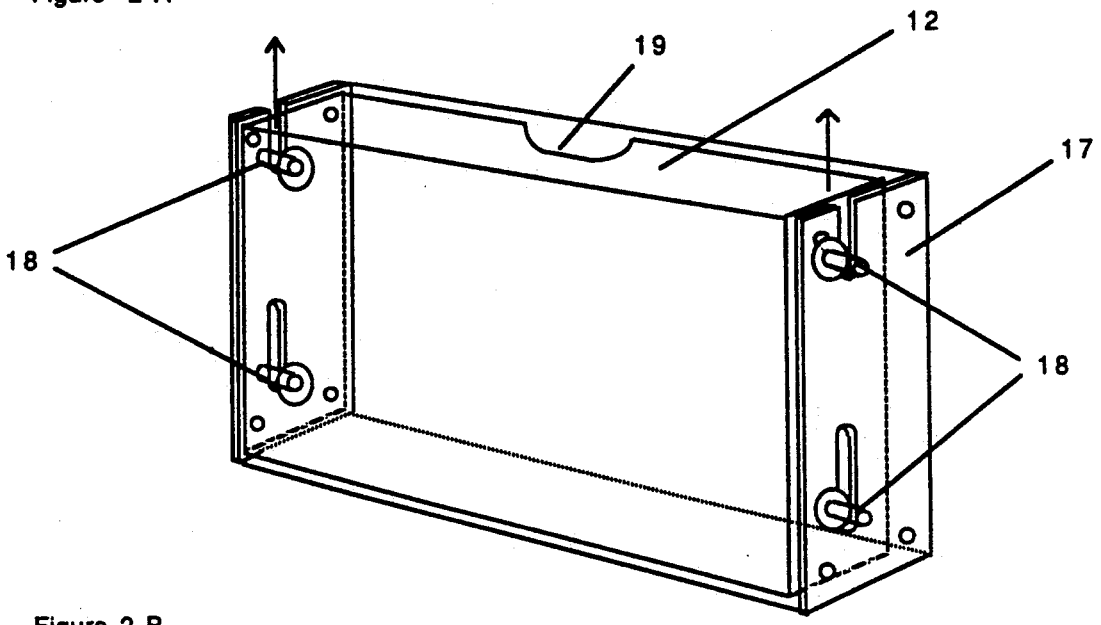
FIG. 2A. Detailed view of utility box and compartment from end of cabinet in a substantially closed and folded position.

A cabinet according to a preferred embodiment of the invention is illustrated in FIG. 1: Item 1 in this embodiment is a hinged top which locks into place in a vertical position where opened. A hinged front panel 2 folds down, locks into a horizontal position and provides a flat surface on which to prepare food. A locking device 3 comprises an elbow-like support hinge mechanism and is used for both the hinged top and the front panel.

The body of the cabinet comprises five compartments which divide the storage space. An upper compartment 4 is open from the top and provides suitable depth for the storage of plates, cups, mugs, paper towels, toiletries, etc. A lower compartment 5 provides for storage of large cookware such as pots, pans and so forth. At the top of the compartment an extendible shelf 7 provides a removable cutting board and a surface for the placement of food condiments during food preparation. Forward sliding trays 6 in the lower compartments hold stored items and allow maximum accessibility of front and rear located parcels. A smaller lower compartment 8 provides for the storage of standard sized boxed and canned food items. An extendable drawer 9 provides for the storage of small miscellaneous items. An upper compartment 10 with a shallow depth is also open from the top and is designed for the storage of cooking and eating utensils. This compartment contains a folding and extending towel rack 11 which consists of pivot arms and a dowel. On the outer edge of the upper compartment 4 there is small compartments comprising an extendable, convertible box 12 with compartments for holding soap and other toiletries.

Figure 2B:
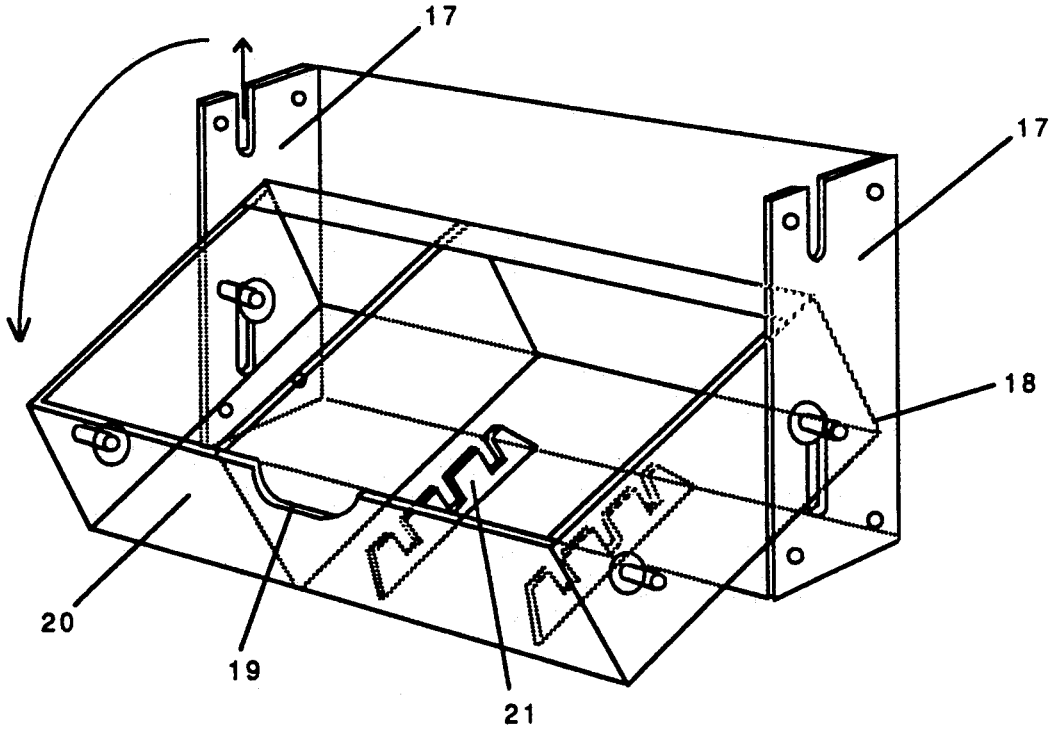
FIG. 2B. Detailed view of utility box and compartment from end of cabinet in a substantially open and extended position showing access of contents.

FIG. 2A shows detail of toiletry box 12 with a mechanism that provides for the containment and locking into place of the toiletry box under the hinged lid of the cabinet. Sliding hinge pins 18 secure the toiletry box inside the frame of the cabinet by means of slotted brackets 17. FIG. 2B shows the deployment of the toiletry box with manual, vertical displacement of the box by means of a thumb groove 19 and folding outward into an accessible position. The box 20 is designed to contain multiple compartments that can include the storage of soap or a soap dispenser and a compartment 21 with a rack for storage of tooth brushes.

Other features of the said cabinet in the embodiment shows a collapsible paper towel rack 13, Battery-powered fluoroescent lamp 14 and utensil hooks 15 attached to top 1. The chuck box has two chest type handles 16 on both ends for carrying.

It will be apparent to a person with skill in the art that there may be alterations made in detail with out departing from the spirit and scope of the invention. Among these variations are the size and material of construction, which, in the preferred embodiment is plywood.

CONCLUSION

One can see that this cabinet brings together a combination of features that provides unique utility to the modern camper or remote site worker. This cabinet provides a means for the storage of all basic kitchen utensils, cookware and supplies in a single container, and a means for transporting these supplies from storage areas to a vehicle then to campsite or remote area. Furthermore, it provides a compact and ergonomic design for the maximum utility at a modern campsite. It converts into a portable kitchen for use day or night and provides easy access to contents and closes easily to secure contents from vermin. It comprises a variety of features that transforms preparation, the camping excursion as well as the meal time into an enjoyable experience.

I claim:

1. A cabinet for storing equipment and supplies for campers and presenting the equipment and supplies for use comprising:

rectangular frame means comprising a bottom, a back, and first and second ends, for supporting and enclosing internal compartments and elements;

front panel means hinged to the bottom of the frame means and foldable outward;

first locking means attached to the frame means and to the front panel means for supporting the front panel means in a substantially horizontal aspect, providing a table and work surface;

top closure means hinged to the back of the frame means and foldable outward;

second locking means attached to the frame means and to the top closure means, for supporting the top closure means in a substantially vertical aspect;

at least one open compartment within the frame means accessible from above with the top closure means locked in its substantially vertical aspect;

at least one drawer means slideably engaged in the frame means, and extendable with the front panel in its substantially horizontal aspect;

at least one extendable tray means slideably engaged in the frame means, and extendable with the front panel in its substantially horizontal aspect and, a fold-out towel rack, the towel rack comprising first and second pivot arms both pivoted to the frame means, and at least one dowel extending between the first and second pivot arms, the pivot position located at one of said ends to allow said at least one dowel to fold into said one open compartment within the frame means, and to a position outside of the frame means with the top closure means open.

2. A cabinet as in claim 1 further comprising a battery-powered fluorescent light attached to the undersurface of the top closure means, so the light is enclosed in the cabinet when the top closure means is closed.

3. A cabinet as in claim 2 further comprising a collapsible holder for paper towels and at least one utility hook attached to the top closure means on the same surface as the fluorescent light.

4. A cabinet as in claim 1 further comprising a utility compartment housed in the upper edge in one of the first and second ends, and the utility compartment comprising:

a rectangular tray; and a rectangular receptacle of substantially the size of the tray, the receptacle indented into one of the first and second ends of the frame means at the upper edge of the end;

the rectangular tray pivotally mounted within the receptacle and rotatable to present the tray for access with the top closure means open, being retained within the receptacle with the top closure means closed.

5. A portable cabinet for storage and presenting for use equipment and supplies for a camper comprising:

a rectangular frame comprising a bottom, a back, a vertical internal partition, first and second ends;

a front rectangular panel is hinged to the bottom of the cabinet and covers a front face of the cabinet when closed and pivots open to a locked horizontal position providing a planer work surface:

a top rectangular panel is hinged to the back of the frame and open to a vertical locked position providing a surface for attachment of a battery powered fluorescent lamp, towel dispenser and a plurality of hooks which together are positioned on the surface of the of the panel so as to be contained within the cabinet when said top panel is in a closed position;

two upper compartments are accessible from above, the first compartment with a shallow recess and the second compartment with a deeper recess;

two lower compartments are accessible from the front, the lower compartments include slidable trays serving as moveable storage platforms which are slidable over the hinged front panel when the front panel is in the opened position;

a slidable shelf at a top of a first of said lower compartments which is removable for use as cutting board;

a single drawer located between one of the upper compartments and a second of said lower compartments;

a fold-out towel rack comprising first and second pivot arms attached to a dowel and positioned at a end of one of the upper compartments such that the rack is contained within the cabinet in the closed position and is pivoted outward over and against a first one of the frame ends in an accessible position when the top is in the vertical open position;

a fold out utility compartment housed in a second one of the frame ends, said utility compartment is contained within the cabinet when the top is in the closed position and is folded out into an accessible position when the top is in the open position.

6. A cabinet as in claim 5, wherein the utility compartment comprises:

a box hinged with a sliding pin mechanism consisting of two pairs of pins, a lower pair comprising a hinge and a upper pair comprising a locking and positioning means;

the sliding pin mechanism functions by allowing said box to open by lifting the box vertically and rotating it outward on the lower pair of pins.

* * * * *